United States Patent [19]

Burke et al.

[11] 4,398,472

[45] Aug. 16, 1983

[54] ELECTRIC BURNER FOR OXIDIZING OVEN

[75] Inventors: Richard E. Burke, Hixson, Tenn.; Edward H. Harris, Kissimmee, Fla.; Joseph W. Bolton, Signal Mountain, Tenn.

[73] Assignee: Hudson Wire Company, Trenton, Ga.

[21] Appl. No.: 386,872

[22] Filed: Jun. 10, 1982

[51] Int. Cl.[3] ..... F23G 3/04

[52] U.S. Cl. ..... 110/250; 34/72; 110/210; 110/191; 219/261; 219/536; 219/388; 373/134; 432/72; 432/8; 432/59

[58] Field of Search ..... 219/260, 261, 388, 267, 219/536, 537, 270, 552, 553; 110/191, 104 R, 101 R, 260, 229, 263, 210, 250, 254; 34/18, 41, 48, 72, 23; 126/101; 431/72, 159; 432/59, 8, 65, 72, 49, 64, 48, 152, 148; 373/132, 134

[56] References Cited

U.S. PATENT DOCUMENTS

| | | | |
|---|---|---|---|
| 2,804,694 | 9/1957 | Clipsham | 432/72 |
| 2,921,778 | 1/1960 | Ruff | 432/48 |
| 3,106,386 | 10/1963 | Harris | |
| 3,183,604 | 5/1965 | Stauffer | |
| 3,183,605 | 5/1965 | Argue et | |
| 3,202,118 | 8/1965 | Baldine | |
| 3,265,033 | 8/1966 | Tauze | |
| 3,351,329 | 11/1967 | Thoma | |
| 3,467,035 | 9/1969 | Anders | |
| 3,776,148 | 12/1973 | Hapgoc | |
| 3,786,165 | 1/1974 | Barbier et al. | 373/134 X |
| 3,810,736 | 5/1974 | Dumas | 432/59 |
| 4,303,387 | 12/1981 | Burke et al. | 432/72 |

*Primary Examiner*—Volodymyr Y. Mayewsky
*Attorney, Agent, or Firm*—Alan Ruderman

[57] ABSTRACT

A recirculating oven in which air and oxidized gases from a burner tube are directed to evaporation zone outlets at the bottom of the oven and curing zone outlets at the top and fed into a pair of wire work chambers, the gas streams mixing between the zones and return with volatile substances through a return duct to a burner mounted in the upper portion of the burner tube. The burner tube is mounted within a burner tube housing partitioned so that the volatile fumes returning to the burner are maintained separately from the oxidized gases and air exiting from the burner tube. The burner is electrically energized and has a cylindrical housing supporting a number of radial vanes supported between spaced baffle plates, the vanes imparting a vortex pattern to the gases entering holes in the housing periphery. A support plate on the top of the housing carries two high temperature ceramic igniter heater elements surrounded by a multiplicity of resistance type electrical heating elements. The electrical heating ele- the returning gases and the ceramic se the gases to ignite and incinerate nts of the gas. A conically shaped v the spaced plates directs the e housing toward the center.

Drawing Figures

ELECTRIC BURNER FOR OXIDIZING OVEN

BACKGROUND OF THE INVENTION

This invention relates to high temperature electric burners and more particularly to an electric burner for evaporating, curing and incinerating noxious and volatile gases in an oven so that the gases exhausting from the oven are at substantially clean levels.

In, for example, ovens for processing enamel coated wire, extremely high temperatures must be generated to oxidize the volatile gases derived from the solvent carrier. In the wire coating process, the coating is disolved or suspended in a liquid solvent or carrier and the wire is passed through this bath to obtain an even coating. Consequently, a wet film is present on the wire which thereafter is passed through the oven to evaporate the solvent or carrier and to cure the remaining solid coating material.

It has been known for some time that separate control of the evaporation and curing processes is required to obtain wire at a high processing volume with good results. To this end the prior art ovens provide separate evaporating and curing zones, the wire first passing through the evaporating zone and heated by gas entering adjacent the wire inlet, and then through the curing zone and heated by gas entering adjacent the outlet, the gas exiting the work chamber through a common outlet between the zones. Since obnoxious, if not noxious, vapor and fumes from the solvent are released by the process, the gases leaving the zones are recirculated and routed to either a combustion chamber and through a catalytic burner, or to the flame generated by a high temperature natural gas burner for a sufficient period of time to oxidize the volatile vapors and fumes. Catalytic oxidizer ovens are illustrated in the U.S. Pat. Nos. 3,351,329 (Thomas); 3,183,605 (Argue et al); 3,183,604 (Stauffer); 3,106,386 (Harris); 2,921,778 (Ruff) and 3,265,033 (Touze et al). Ovens constructed with a non-catalytic oxidizing natural gas fuel burner are illustrated in U.S. Pat. Nos. 3,810,736 (Dumas) and 4,303,387 (Burke et al).

However, in many areas of the world, including many of the developing nations, natural gas and oil are not readily or economically available. Since the available energy sources are utilized in the generation of electricity, electricity in such locations is available for use in industrial processes. At this time no effective electrical burners capable of oxidizing volatile vapors and fumes such as those released from the wire enameling process are available.

SUMMARY OF THE INVENTION

Consequently, it is a primary object of the present invention to provide an electrical burner that operates at extremely high temperatures for oxidizing volatile vapors and fumes.

It is another object of the present invention to provide an electrical burner having one or more igniter elements operating at extremely high temperatures for igniting volatile gases passing through the burner.

It is a further object of the present invention to provide an electrical burner for an enameling oven for igniting and oxidizing a recirculated fume and volatile gas carrying air stream so that the volatile fumes and gases are substantially incinerated.

It is a still further object of the present invention to provide an electrical burner for an oven in which a gas stream is exposed to the heat of the burner for a sufficiently long duration to oxidize fumes and volatile components in the gas stream to substantially clean exhaustable levels.

It is a yet still further object of the present invention to provide an electrical burner having a multiplicity of electrical heating elements disposed for superheating a solvent laden gas stream, the heating elements being disposed about at least one electrical igniter operating at extremely high temperature for igniting the gases, the burner having vanes for imparting a swirl to the gas stream so that the gases are exposed to the heating elements and the igniter for a sufficiently long duration to oxidize the gases.

In accordance with the principles of the invention an electrically energized burner is provided which comprises a heat plug having a substantially cylindrical housing supporting a number of radial vanes for imparting a vortex type swirling pattern to the gases entering through openings in the housing periphery, the interior of the housing having at least one extremely high temperature electrical longitudinally extending ceramic type centrally mounted igniter unit surrounded by a multiplicity of longitudinally extending resistance type electrical heating elements. Heating of the volatile gas laden air stream is accomplished by both the resistance type elements and the ceramic type igniters, the resistance elements acting to superheat the stream and the centrally mounted igniter elements operating at extremely high temperatures to ignite the gases. The lower end of the burner heat plug below the vaned section has a conically shaped annular rim extending from the periphery of the housing to direct the gases toward the center so that the gases do not by-pass the lower ends of the heating units.

In the preferred form of the invention the vanes are supported by a series of longitudinally spaced plates having apertures through which all the heating units extend individually to maintain their separation and to provide a rigid structure.

The heat plug elements are supported by a face plate at the upper end thereof and may be positioned within a cylindrical shell in an oven, the lower portion of the heat plug having a skirt which together with the cooperating elements of the shell form a labyrinth seal. The shell forms a portion of the oven burner tube and is positioned within a burner tube duct. The burner tube supplies the substantially clean high temperature air to one or more air chamber housings which communicates the air to the wire where the air again picks up the coating solvents as the solvent evaporates and the coating cures. The gas laden air is returned to the burner tube duct and enters holes in the shell which communicate with the holes in the heat plug housing, the holes gradually increasing in size toward the upper end of the oven.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

A burner constructed in accordance with the present invention may be utilized in the environment of a drying and curing oven and is so disclosed herein. The specific oven may be one having a single air chamber and work chamber, but preferably has a pair of air chambers individually feeding a respective work chamber such as the oven illustrated in Burke et al, U.S. Pat. No. 4,303,387, assigned to the same assignee as the present invention. Although a complete description of the oven with a gas fired burner may be had by reference to the aforesaid Burke et al patent, for a full understanding of the invention in the preferred environment certain details of the oven will be described herein. However, the invention should not be construed to be limited to such an environment since a burner having the principles of the invention may be utilized in other ovens having the requirement of gas pollution incineration.

Figure 1:
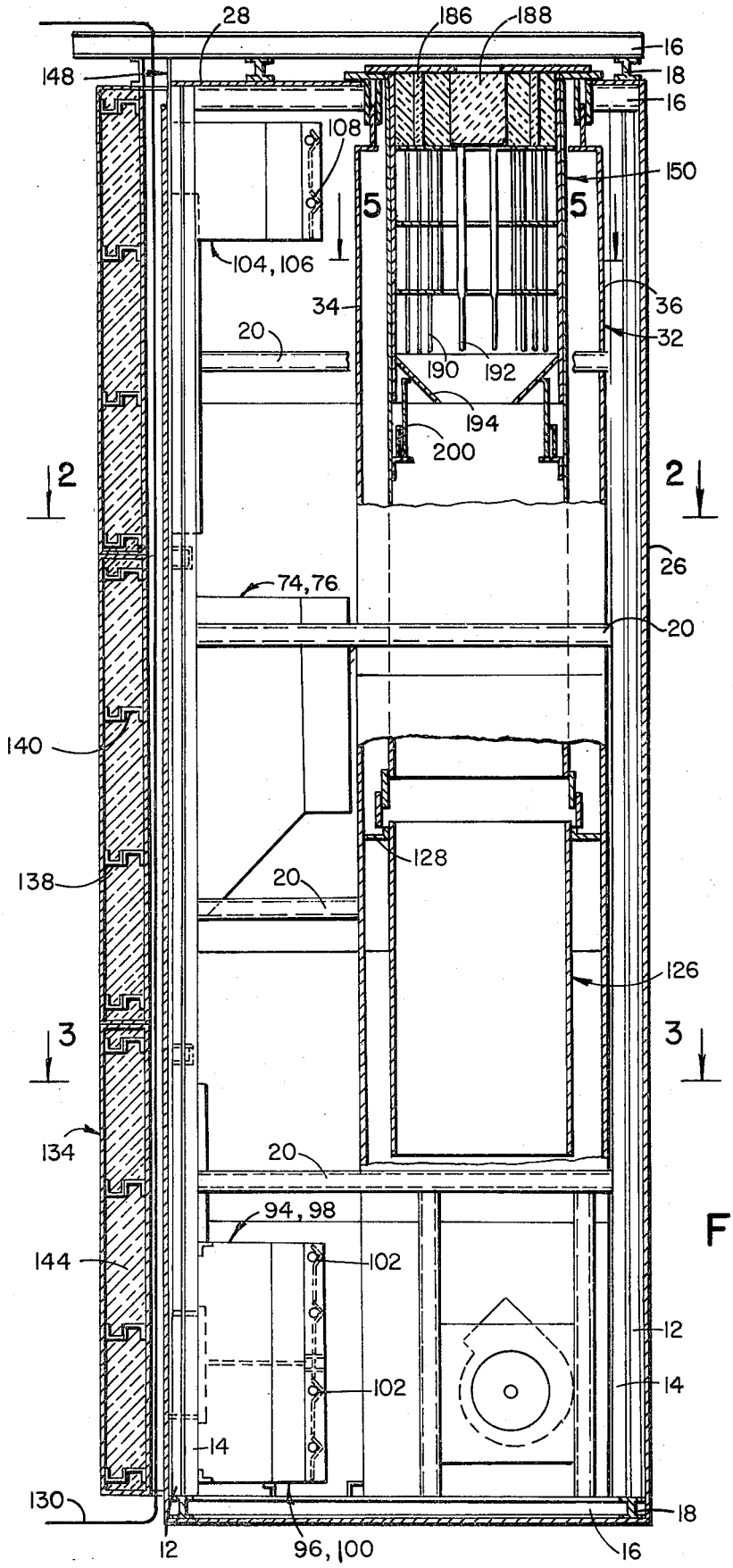
FIG. 1 is a vertical sectional view through an enameled wire drying and curing oven incorporating an electrical burner constructed in accordance with the principles of the present invention.
Figure 2:
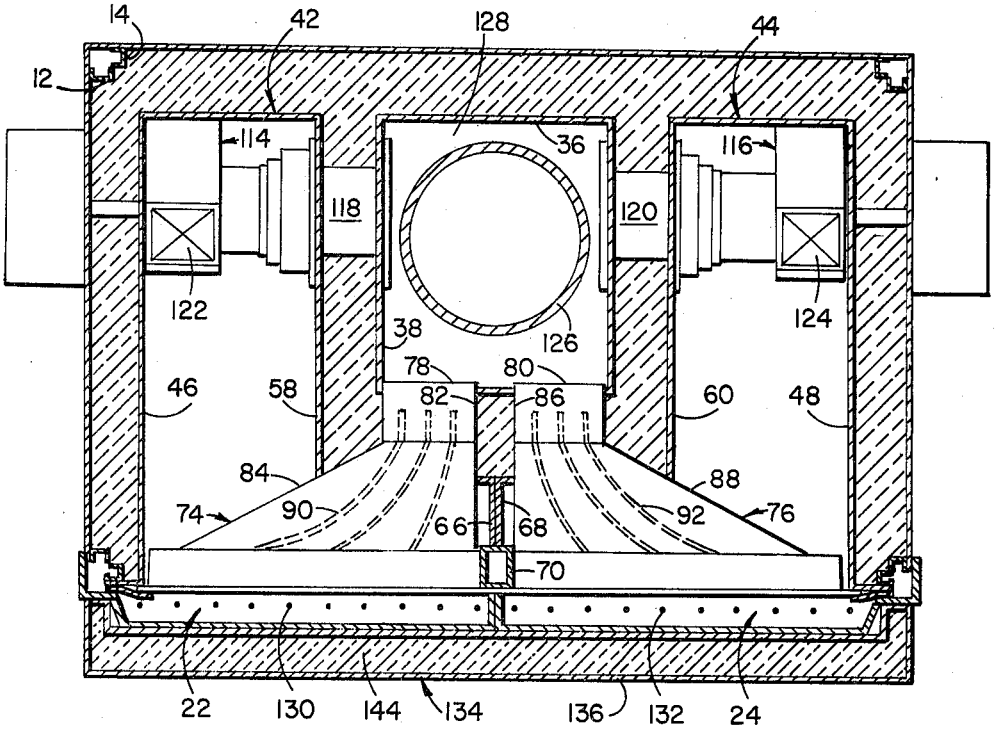
FIG. 2 is a horizontal cross sectional view taken substantially along line 2—2 of FIG. 1.
Figure 3:
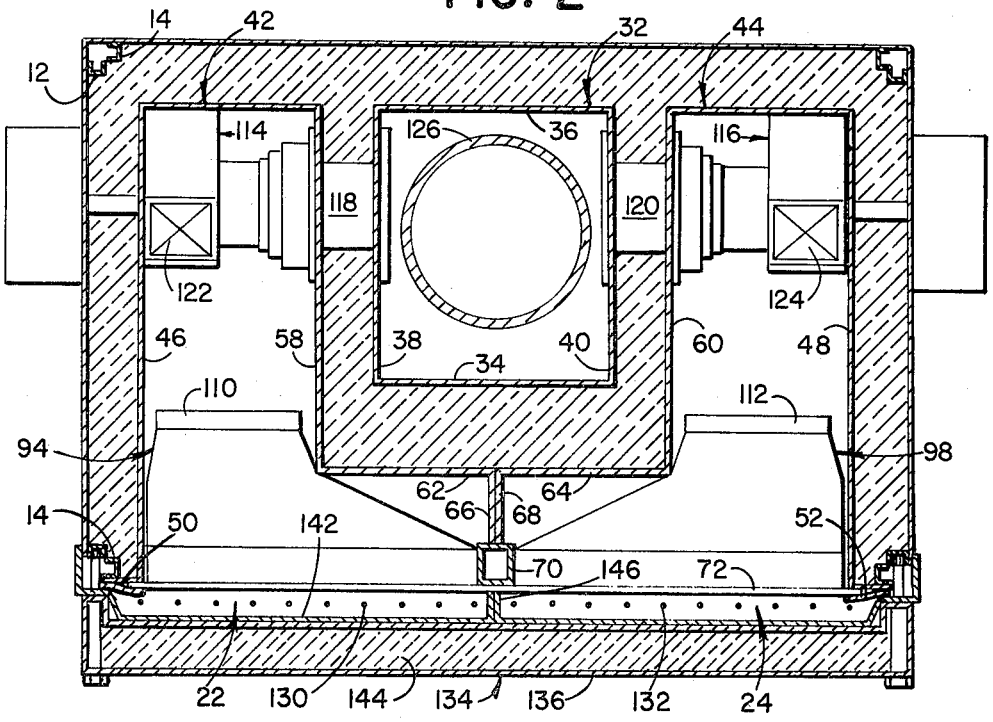
FIG. 3 is a horizontal cross sectional view taken substantially along 3—3 of FIG. 1.

The oven, as illustrated in FIGS. 1-3, has a structural framework including a plurality of vertically extending channel members 12 and 14 secured together at each corner and secured to structural members 16 and 18 respectively at the top and bottom thereof. A number of vertically spaced channel members 20 are secured to and connect adjacent channels 14 to provide a rigid structural skeletal framework. Positioned and secured to the outer surfaces of the framework about the entire framework of the oven with the exception of the wire work chambers 22, 24 is an outer skin 26 comprising sheet steel. Similarly, an outer skin 28 forms the top surface of the oven, while insulation 30 may be positioned about the interior of the outer skin.

The framework together with the wall structure comprises a rigid casing within which a number of preferably modular elements are disposed so that a minimum amount of contact between the internal components and the outer structure exists. Thus, positioned within the oven casing in a substantially central location is a burner tube duct or housing generally indicated at 32 and having a substantially rectangular cross sectional configuration as best illustrated in FIG. 3. The burner tube housing includes front and rear walls 34, 36 respectively and side walls 38 and 40, the burner tube housing preferably comprising a number of sections of sheet steel assembled to each other vertically. Disposed at each side of the burner tube housing is a respective right and left air chamber 42, 44, each constructed of a number of sections of sheet steel secured together to form a vertically elongated air plenum. Each air chamber 42, 44 as best illustrated in FIG. 3, comprises an upstanding outer side wall 46, 48 respectively having an outwardly extending lip 50, 52 attached at its outer edge to the adjacent corner channel member 14. At the rear of the air chambers the walls 46, 48 have a wall portion 54,56 extending inwardly toward the burner tube housing 32 and terminates in a wall 58, 60 that extends from the respective wall 54, 56 forwardly toward another wall section 62, 64 directed inwardly toward the center line of the burner tube housing and terminating in a short wall section 66, 68. The front edge of the walls 66, 68 are secured to a vertically extending elongated box beam 70. A plate 72 is secured to the front edges of the channel members 14 and the front surface of the beams 70 to define the rear closure of the work chambers 22, 24.

Formed through the plate 72 at each side of the beam 70 are four spaced openings (not illustrated) which communicate the work chambers with air supply and return modules. One of the openings on each side of the beam is located at substantially the vertical medial portion of the plate 72 and a return or recirculated air module 74, 76 is secured to the plate in communication with the respective opening. Each return module 74, 76 may be of a substantially horn shaped configuration having a respective smaller outlet section 78, 80 disposed and secured in communication within the interior of burner tube housing 32, the return module 74, 76 having respective side walls 82, 84 and 86, 88. Air foil shaped vanes 90, 92 may be disposed within the respective return module for smoothly increasing the velocity of the return gases from the work chambers to the burner tube housing 32. Evaporation zone supply modules 94, 96, and 98, 100 are positioned within the lower section of each air chamber housing 42, 44 and have frontal openings positioned and opening into holes in the plate 72 for communicating the air chambers with the respective work chamber through two of the openings of each chamber. The evaporation zone modules may have pivotably mounted dampers 102 externally movable to control the supply of air each module delivers. Another pair of supply modules, these being curing zone modules 104, 106 similar to the evaporation zone modules, are positioned within the upper section of the respective air chamber housings 42, 44 in communication through upper opening in each air chamber with the respective work chamber. Each curing zone module may include dampers 108 similar to the damper 102. Each supply module as illustrated in FIG. 3 with regard to the evaporation zone modules 94 and 98 has a small inlet section 110, 112 to reduce the velocity of the supply air into the work chamber, and has a side wall shaped to fit about the respective air chamber wall flaring outwardly as illustrated.

Positioned within each air chamber 42, 44 may be a respective motor driven centrifugal blower assembly 114, 116 having inlets communicating with the burner tube housing 32 through ducts 118, 120 respectively and having a respective outlet 122, 124 disposed within the corresponding air chambers 42, 44 for circulation of the working gas from the burner tube housing to the respective evaporator zone and curing zone supply modules.

Mounted within the burner tube housing 32 is a substantially cylindrical elongated burner tube or shell 126 preferably comprising a pair of tubular sections. At the junction of the sections the burner tube extends through and is substantially sealed to a substantially horizontal plate 128 extending between the four walls of the burner tube housing 32 to divide the burner tube housing into a lower or outlet section below the plate 128 and an upper or return section above the plate, the plate acting to seal the sections from one another. As illustrated in FIG. 1, the openings into which the outlets of the return modules 74 and 76 extend is above the plate 128 and the inlets to the blowers 114, 116 are below the plate 128.

Wire 130 and 132 is fed through the respective work chambers 22, 24 formed between the plate 72 and a door, generally indicated at 134, and comprising vertical panels mounted one upon the other, each panel having an outer skin 136 spaced by a pair of channels 138, 140 from an inner skin 142 and filled with insulation 144. The inner and outer skin are shaped so that the sides of the door are interconnected to the oven channel members 12 and form a recess in the door between the main frontal surface of the inner skin 142 and the plate 72. A vertical rib 146 is formed on the medial portion of the inner skin and extends rearwardly to engage the plate 72 to provide a seal between the work chambers 22 and 24. Consequently, the wire 130 in the work chamber 22 can be maintained at a different temperature profile condition as supplied by the blower 114 than the wire 132 in the work chamber 24 supplied by the blower 116.

The wire enters the respective work chamber through an opening at the bottom of the oven and is fed upwardly. Fresh air may enter with the wire into the open space at the bottom of the work chambers, but it is desirable, if not necessary, for environmental protection, to prevent the solvent laden fumes and gases from exiting through the work chamber space at the top of the oven. To this end air locks 148 should be provided at the top of the oven where the wire exits.

Figure 4:
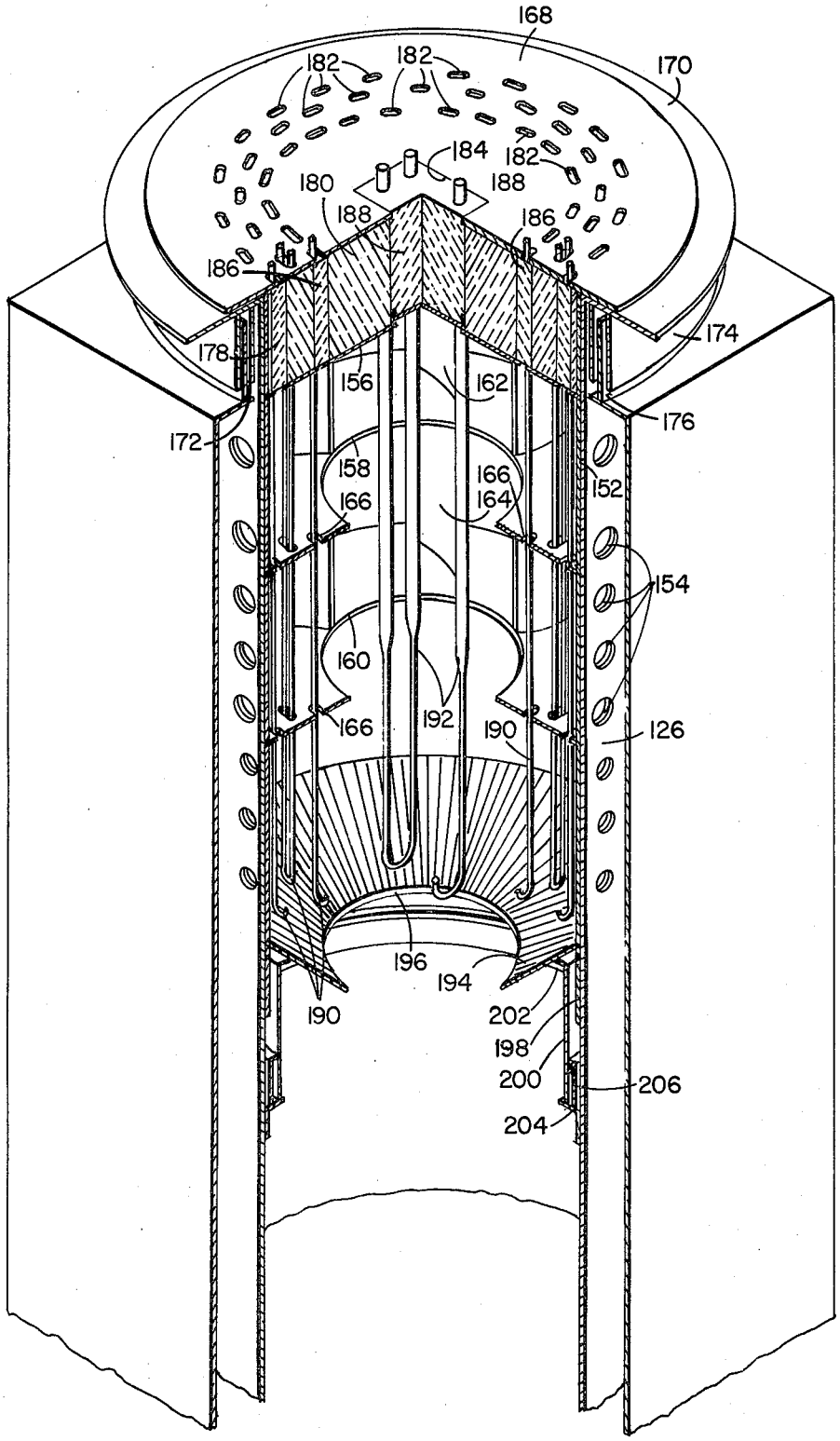
FIG. 4 is an enlarged perspective view of the burner and upper portion of the burner section of the oven with portions thereof broken away and sectioned.
Figure 5:
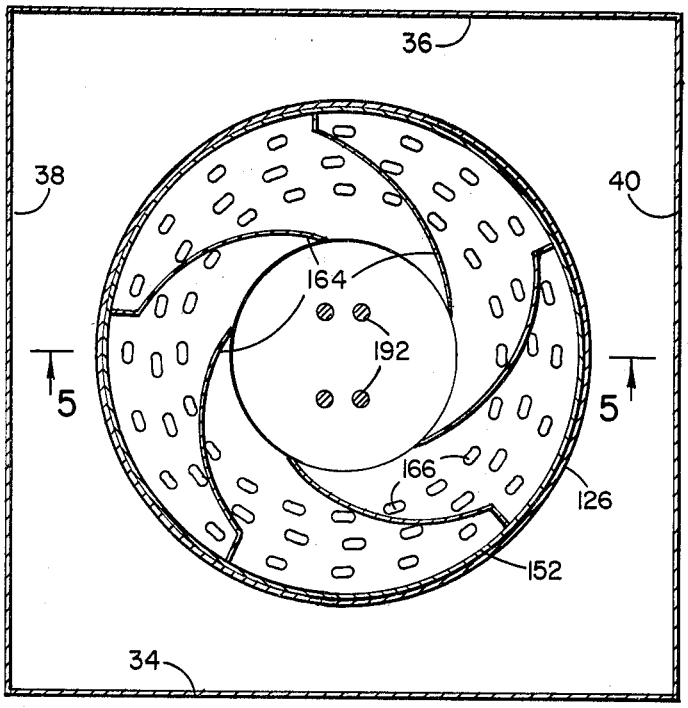
FIG. 5 is a horizontal cross sectional view taken substantially along line 5—5 of FIG. 1.
Figure 6:
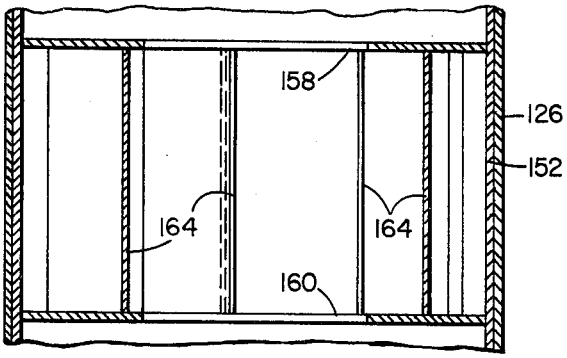
FIG. 6 is a vertical cross sectional view taken substantially along line 6—6 of FIG. 5.

The new electric burner of the present invention is indicated generally at 150 and as best illustrated in FIG. 4 includes a substantially cylindrical burner housing 152 disposed within the burner tube 126 at the upper portion thereof. The particular shape of the housing 152 is not critical but is cylindrical in the preferred embodiment so as to fit properly within the tube 126. Both the burner tube 126 and the burner housing 152 have a plurality of holes 154 spaced about their respective peripheries for communicating the recirculated gases within the burner tube housing 32 returned from the return module 74, 76 to the interior of the housing 152. The holes 154 gradually increase in area toward the upper part of the housing 152 and the tube 126, so that the majority of the returning pollutant laden gas stream will enter the housing at the top and be drawn downwardly for complete incineration.

Extending radially from the interior wall of the burner housing 152 are a number of spaced apart annular or ring shaped plates or baffles, three of which 156, 158, 160 being utilized in the burner of the preferred embodiment. The upper plate 156 rather than having a large circular central opening as does the plate 158 and 160 has instead a small rectangular opening for purposes hereinafter made clear. Connected between the lower surface of the upper plate 156 and the upper surface of the plate 158 are a plurality of spaced spirally arcuate vanes 162 while similar vanes 164 are connected between the lower surface of the plate 158 and the upper surface of the plate 160. Each of the vanes 162, 164 has an arcuate configuration extending tangentially toward the central opening of the plates 158 and 160 so as to increase the velocity and induce a swirling motion, in this case a clock-wise motion, to the gases entering through the holes 154, thereby causing the gases to flow in cyclonic fashion, and in a downward direction through the burner housing 152. Each of the plates 152, 158, 160 has a multiplicity of aligned apertures 166 extending therethrough and spaced substantially equally apart. As illustrated, the apertures 166 are, for convenience and for purposes of assuring complete incineration of the gases, arranged in three rows radially spaced apart intermediate the central opening and the wall of the housing 152.

Secured to the top of the housing 152, as by welding or the like, is a support plate 168. The support plate 168 rests on and may be attached to an access plate 170 which is secured to the top of the burner tube 126. The access plate 170 includes a pair of spaced apart flanges 172 and 174 depending from the bottom surface thereof which are disposed on opposite sides of a flange 176 upstanding from the top surface 178 of the burner tube housing 32. The flanges 172, 174 and 176 form a labryinth seal between the burner tube 126 and the burner tube housing 32. A hollow cylindrical shell 178 may be secured as by welding to and between the baffle plate 156 and the support plate 168 and filled with a mineral or fiberglass insulation 180. Extending through the support plate 168 and the insulation 180 is a multiplicity of apertures 182 which are aligned with the apertures 166 of the plates 152, 158, 160 and a central opening 184, which, as illustrated, may be of a rectangular shape. Disposed in each of the apertures 182 is an insulated holder 186 while an insulated holder 188 is disposed in the opening 184. Each of the holders 186, 188 is formed from a high temperature resistance insulated material such as firebrick and preferably has a narrowed portion on the top and bottom where they are fitted into the respective apertures in the plates 156 and 168. Preferably the firebrick holders 186 and 188, and the insulation 180 are positioned in the cylindrical shell 178 prior to the welding of the plate 168 to the top of the shell.

Each of the holders 186 has a pair of holes which receive the ends of respective heating element 190. In the preferred embodiment sixty of these elements are utilized in the burner. Each of the elements 190 is a U-shaped resistant heating member having its free ends extending through the respective holder 186 and extending downwardly through the burner through the apertures 166, the lower U-shaped ends of the elements terminating below the annular plate 160. The elements 190 are metallic units such as incoloy and are readily available from a number of sources such as T.P.I. of Johnson City, Tenn. The upper end of the elements 190 within the firebrick may be sheathed in sleeves to provide rigidity between the firebrick and the heating members. In operation, the current supplied to the heating elements 190 is controlled to maintain a constant temperature of operation by means of saturable-core reactors or similar solid state control units (not illustrated).

The holder 188 preferably has four holes for receiving the ends of a pair of very high temperature igniters 192. The igniters are also U-shaped members having their free ends extending from the top of the holder 188 and their lower U-shaped ends extending downwardly through the central openings in the plates 156, 158 and 160. The igniters operate continuously at extremely high glowing temperatures for extended periods of time and must be highly resistant to oxidizing agents. Thus, the igniters are a combination metallic and ceramic material such as a cermet which may be made from molybdenum disilicide. Such units are available under the trade name Kanthal and standard elements such as Kanthal Sp and N are manufactured by Kanthal Division of Buten-Kanthal Sweden of Hallstammar, Sweden. When operating, these units form an oxidation sealant about them and can operate continuously at temperatures of 1700 degrees C. In the burner of the present invention the high surface temperatures of the igniter initiate and maintain ignition of the gases which are burned at temperatures of approximately 1400 degrees F.

Secured to the inner wall of the housing 152 substantially at the disposition where the heating elements 190 and igniters 192 are bent into the U-shape is a truncated conical baffle 194 which has a central opening 196. The baffle directs the swirling gases toward the center of the burner and the burner tube and ensures that the gases contact the lower U-shape ends of the heating elements 190 and igniters 192. The baffle 194 is secured to the wall of the burner housing 152 above its lower end so that a skirt 198 is formed which extends downwardly to approximately the elevation of the mouth of the opening 196. The skirt 198 forms one wall of a lower labyrinth seal, which has an inverted L-shaped wall 200 including an inwardly facing flange 202 secured to a flange 204 on the inside of the burner tube 126. Another inverted L-shaped wall 206 is secured on the flange 204 and forms a portion of the labyrinth seal.

The upper extremities, i.e. the free ends of each of the resistance heating elements 190 and the igniters 192 are connected to respective lead wires and electrical bus bars, which are not illustrated since they are conventional means for conducting electrical current.

In operation, when the recirculated pollutant laden gas stream is returned to the upper section of the burner tube housing 32, the gas enters the holes 154 in the burner tube 126 and the burner tube housing 152, most of the gas being drawn into the larger holes at the top of the burner. The gases are given a swirling motion by the vanes 162, 164 and pass over the resistance heating elements 190 and the igniters 192. As the gases contact the resistance heating elements 190 the gases are superheated above their approximately 800 degrees F entering temperature and are ignited upon contact with the igniters 192 operating above the auto-ignition temperature of the solvents. As stated above the surface temperature of the igniters is approximately 1700 degrees C. This high temperature ignites the gases, and together with the burning gases maintains combustion of the gases at approximately 1400 degrees F thereby incinerating the solvents so that any gases exhausted from the oven are substantially pollutant free.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. An electric burner for an incinerating oven comprising a hollow housing elongated along a longitudinal axis and having a multiplicity of openings communicating the interior with the exterior thereof, a plurality of arcuately shaped vanes, means for mounting said vanes in spaced relationship about at least an upper portion of the interior of said housing and extending from the interior surface of the housing toward a central portion spaced from said axis, a support plate secured to and closing one end of said housing, that end being defined as the top end, a deflector plate secured to the housing adjacent the bottom end and having a substantially central aperture such that gases entering said openings may exit through said aperture, a multiplicity of elongated U-shaped electrical resistance heating elements, each of said elements having a pair of free ends adapted to receive electrical current, means carried by said support plate for mounting said elements in spaced apart relationship in said housing with the free ends extending from the top of the support plate, at least one elongated U-shaped ceramic heating element capable of operating at a surface temperature above 1400 degrees F for igniting gases flowing through said housing, each ceramic element having a pair of free ends adapted to receive electrical current, and means carried by said support plate for mounting said ceramic elements in said housing substantially intermediate said resistance elements with the free ends extending from the top of said support plate.

2. An electrical burner as recited in claim 1, including at least a pair of baffle plates secured to said housing in spaced disposition along said axis, each of said baffle plates having a central aperture in substantial alignment with the aperture in said deflector, each ceramic heating element freely extending through the apertures of said baffle plates, said means for mounting said vanes including means for securing said vanes to opposed surfaces of adjacent baffle plates, and said baffle plates having a multiplicity of aligned holes for receiving a respective resistance heating element.

3. An electric burner as recited in claim 2, wherein said central aperture in said baffle each plate is substantially circular, and each of said vanes extends tangentially toward the periphery of the central aperture in the baffle plates to which said vanes are secured.

4. An electric burner as recited in claim 3, wherein said housing is substantially cylindrical and said resistance heating elements are disposed within said housing in radially spaced rows intermediate said central apertures and the housing.

5. An electric burner as recited in claim 1, wherein said means for mounting said resistance heating elements and said means for mounting the ceramic heating elements comprise an upper baffle plate spaced from said support plate, means for securing said upper baffle plate to said support plate in spaced relationship therewith, insulated holder means secured to each resistance heating element, insulated holder means secured to the ceramic heating elements, and means for entrapping all of said insulated holders between said support plate and said upper baffle plate.

6. An electric burner as recited in claim 4, wherein said deflector plate comprises a substantially truncated conical annular member, and each of said heating elements is elongated lontigudinally to substantially the disposition where the deflector plate is secured to said housing.

7. An electric burner as recited in claim 5, including a lower baffle plate secured to said housing in spaced relation with said upper baffle plate, a third baffle plate secured to said housing intermediate said upper and lower plates, each of said baffle plates having a central aperture in substantial alignment with the aperture in said deflector, each ceramic heating element freely extending through the aperture of said baffle plates, said means for mounting said vanes including means for securing said vanes to opposed surfaces of adjacent baffle plates, and said baffle plates having a multiplicity of aligned holes for constraining the respective resistance heating element.

8. An electric burner as recited in claim 7, wherein said central aperture in said lower and intermediate baffle plates is substantially circular and each of said vanes extends tangentially toward the periphery of the circular aperture.

9. An electric burner as recited in claim 8, wherein said housing is substantially cylindrical and said resistance heating elements are disposed within said housing in radially spaced rows intermediate said circular apertures and the housing.

10. An electric burner as recited in claim 9, wherein said openings communicating the interior and the exterior of said housing have a larger area at the upper portion of the housing than at the lower portion of the housing, and the area of the openings decrease in increments along the length of the housing from the upper portion toward the lower portion.

11. An electric burner as recited in claim 1 or 6, wherein the bottom end of said housing includes a skirt extending downwardly beyond the bottom of said deflector plate for forming a portion of a labyrinth seal.

12. An electrical burner as recited in claim 5 or 10, wherein said insulated holders comprise firebrick and including insulation disposed about all of said holders.

* * * * *